US005333746A

United States Patent [19]

Bustos

[11] Patent Number: 5,333,746

[45] Date of Patent: Aug. 2, 1994

[54] ARC SYSTEM COOLER DISPLAY RACK

[75] Inventor: Rafael T. Bustos, Alpharetta, Ga.

[73] Assignee: L&P Property Management Company, Chicago, Ill.

[21] Appl. No.: 16,783

[22] Filed: Feb. 11, 1993

[51] Int. Cl.[5] ..... A47F 5/00

[52] U.S. Cl. ..... 211/187; 211/59.2; 211/193; 248/242; 248/243; 108/109

[58] Field of Search ..... 211/193, 187, 59.2, 211/133, 126; 108/111, 109; 248/243, 242

[56] References Cited

U.S. PATENT DOCUMENTS

| | | | |
|---|---|---|---|
| 2,643,170 | 6/1953 | Vanderveld et al. | 211/193 X |
| 3,601,256 | 8/1971 | Bowers et al. . | |
| 3,986,758 | 10/1976 | Heaney | 211/187 X |
| 4,063,518 | 12/1977 | Bustos . | |
| 4,108,085 | 8/1978 | Sheperd et al. | 211/187 X |
| 4,307,671 | 12/1981 | Albano | 248/242 X |
| 4,593,823 | 6/1986 | Fershko et al. | 211/133 X |
| 4,756,430 | 7/1988 | Spamer et al. | 211/193 X |
| 4,809,855 | 3/1989 | Bustos . | |
| 4,850,285 | 7/1989 | Suttles | 211/187 X |
| 4,872,567 | 10/1989 | Bustos . | |
| 4,934,645 | 6/1990 | Breslow | 248/242 |
| 4,960,210 | 10/1990 | Spamer | 211/59.2 |
| 5,088,607 | 2/1992 | Risafi et al. | 211/187 X |
| 5,265,740 | 11/1993 | Hodsden et al. | 211/187 |

*Primary Examiner*—Robert W. Gibson, Jr.
*Attorney, Agent, or Firm*—Wood, Herron & Evans

[57] ABSTRACT

A cooler display rack for use in a walk-in refrigerated cooler. The cooler display rack consists of a series of L-shaped frame sections formed from generally upright posts secured at their bottom end by an elongated shoe to form the individual frame sections. The frame sections are joined to adjacent frame sections by spacer panels and by a plurality of shelves supported in a cantilevered manner between a pair of adjacent posts. The individual shelves are supported between the posts by shelf support brackets and can be selectively positioned vertically along the height of the post, horizontally forward and backward relative to the post, and angularly with a gravity feed inclination between an approximate 8° forward slope and approximate 1° back slope. Bumper wires are inserted through holes in the shelves at the front edge thereof for retaining merchandise contained on the shelves. The arc system display rack of the present invention provides heretofore unachieved flexibility in merchandising self service products displayed on the shelves in that individual shelves can be variably positioned and the cooler display rack requires no front posts which would obstruct access to the merchandise contained thereon.

18 Claims, 4 Drawing Sheets

FIG.1
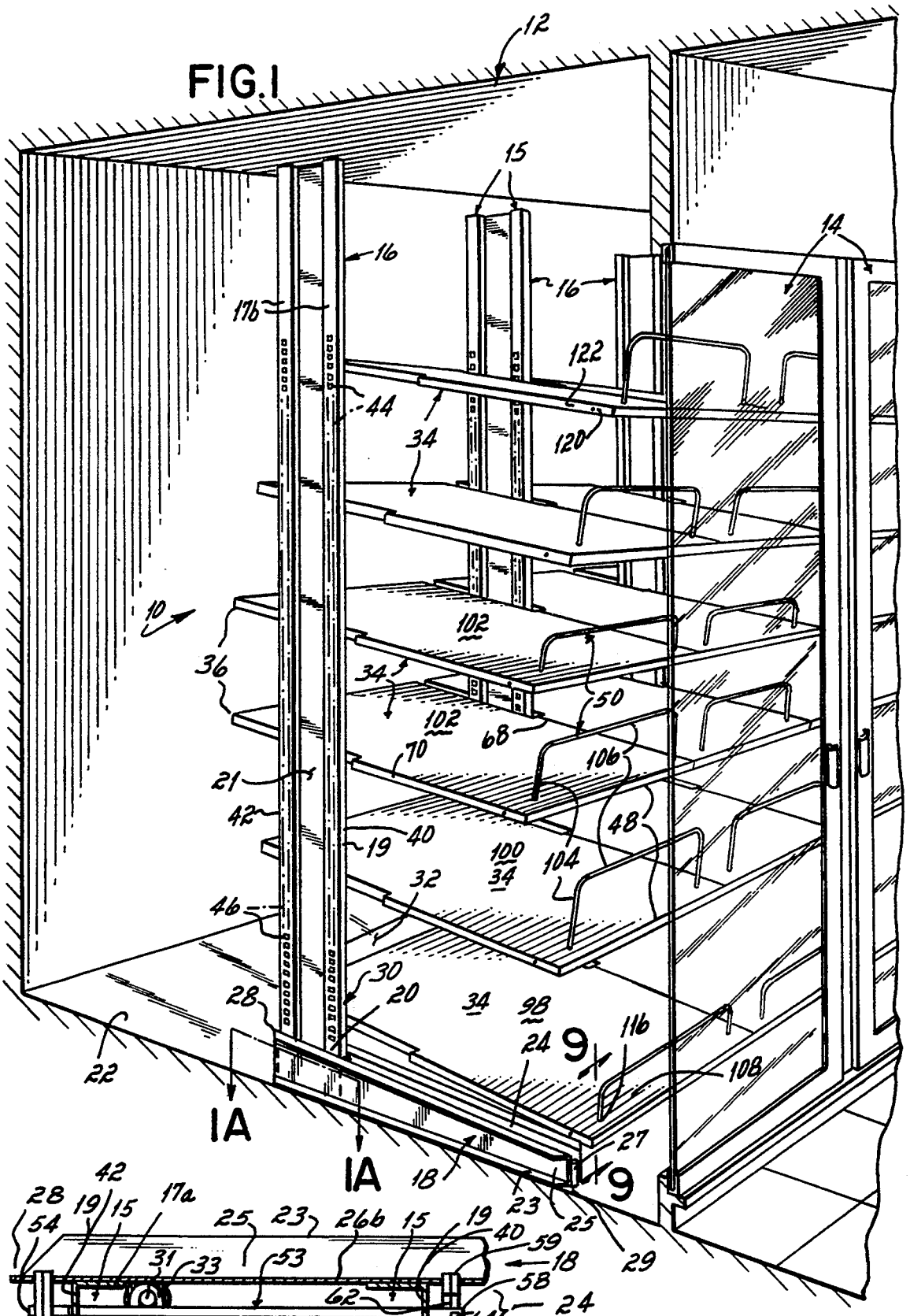
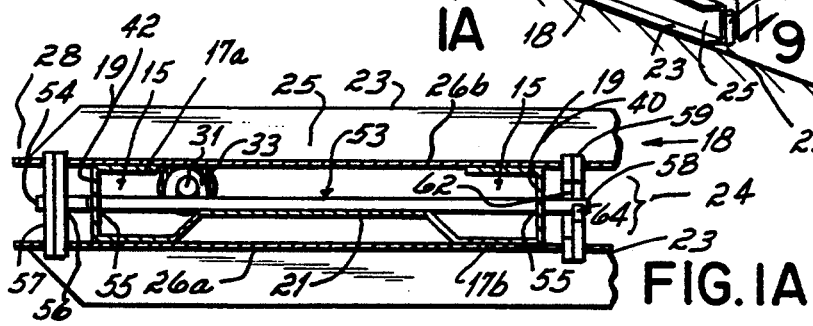
FIG.1A

ARC SYSTEM COOLER DISPLAY RACK

BACKGROUND OF THE INVENTION

This invention relates to display racks. More particularly, this invention relates to an improved display rack for use in combination with a walk-in type cooler.

Display racks are often used in supermarkets and convenience stores to display merchandise generally handled as self-service items. For example, display racks are often used in supermarkets to display cans or bottles of soft drinks, the cans or bottles being removable for purchase by the customer in a self-service manner from the display rack. Frequently the merchandise requires refrigeration to prevent spoiling, therefore, the merchandise display rack is located in a walk-in type cooler or a refrigerated area. The customer is afforded access to the refrigerated merchandise provided on the display racks in the walk-in coolers typically through glass panel doors on the coolers.

Display racks are commonly supported at a front side by a series of posts adjacent the walk-in cooler doors and at a rear side by a corresponding series of posts. In order to provide customer access to merchandise contained on the shelves with as little obstruction as possible, the posts which support the shelves on the display rack are aligned with the posts to which the cooler doors are hinged and supported. In this way, the shelves are secured between the posts and cannot be easily positioned forward or backward and must be of the same width as the cooler door through which a customer gains access to the merchandise located on the shelves.

Shelf and linear footage allocations of space on the display racks in the walk-in coolers are thoroughly analyzed in space and sales merchandising studies conducted by supermarkets and convenience stores. However, the antiquated current cooler shelving configuration as previously described has forced stores to devote an integral number of cooler doors to each vendor or product type which is often inappropriate based on sales merchandising and customer demand studies.

Another common problem in self-service display racks located in walk-in coolers is that of the need to constantly move merchandise forward on the shelf as the forwardmost objects or items of merchandise are removed. Traditionally, supermarkets have had stock clerks regularly move through the store placing new stock on the shelves or moving the older stock forward on the shelf so as to make it more easily accessible to customers.

Another problem with cooler display racks of the type previously described is that the forwardmost item on the shelf, although the most accessible to the customer through the cooler door, is often the least chilled item of merchandise on the shelf. This results from the fact that the rack has been restocked from the front edge of the shelf and the newly stocked merchandise has been chilled in the cooler a lesser length of time than merchandise which remained on the rear portion of the shelf. Additionally, merchandise located at the forwardmost edge of the shelf is nearest the cooler doors which is typically a warmer region than other areas of the cooler due to the large number of lights provided on the walk-in cooler door walls and the customers and store clerks repeatedly opening the doors, thereby allowing chilled air to escape from the cooler which is replaced by warmer ambient air.

To minimize the need for stock clerks to move merchandise forward on the shelves and to allow for the display racks to be restocked from the rear edge of the shelves, there have been numerous display racks developed for self-feeding merchandise forward on the shelf. In general, most of these display structures incorporate slanted or sloped shelves on which the merchandise is displayed. When the forwardmost object in a given column of merchandise on a self-feeding shelf is removed, gravity causes objects behind the front item to move forward in the column until stopped at the front edge of the shelf. Typical gravity feed shelf assemblies of this type are illustrated in U.S. Pat. Nos. 3,203,553 and 2,443,871. These two patents disclose gravity feed racks for cans in which the cans are disposed with their axes horizontal so that the rear can on the shelf can roll down the sloped shelf in response to removal of the lead can in the column.

Another type of gravity feed shelf assembly is disclosed in U.S. Pat. No. 3,279,618. In this patent, cans with their axis disposed in a generally vertical plane slide down a sloped shelf to the front edge thereof.

However, racks of the types disclosed in these patents, while providing gravity feed shelving, do not allow the shelves to be adjusted depending on the needs of the particular cooler configuration or the merchandising requirements of the store. Cooler display racks of the type described still must be positioned with the forward posts aligned with the posts on the cooler doors and with the front edge of the shelf directly adjacent the inside surface of the cooler door.

SUMMARY OF THE INVENTION

It has been an objective of the present invention to provide a cooler display rack which does not require front posts thereby allowing stores to display products depending upon their sales merchandising scheme and not the physical restrictions of the cooler display rack.

Another objective of the present invention is to provide a cooler display rack with self-feeding shelves which can be individually adjusted up and down vertically, back and forth horizontally, and at various shelf inclinations.

Another objective of the present invention is to provide a cooler display rack with shelves which allow access to the forwardmost article thereon by the customer through a cooler display door while still maintaining the merchandise at a chilled temperature.

These objectives of the present invention are obtained by an arc system cooler display rack which has a shelving design that offers unobstructed continuous display of cooler merchandise due to the elimination of the display rack front posts. The elimination of front posts also avoids the need for the shelf width to match the cooler door width. The present invention arc system cooler display rack allows the retailer the opportunity of a more individualized allocation of products based on sales merchandising schemes by permitting merchandise of a particular type or vendor a portion or all of a cooler door width space. Additionally, more merchandise display area is available in the present invention in that access to the shelves is not obstructed by front posts.

The arc system cooler display rack of the present invention is designed to be a free standing unit or for use within a walk-in cooler of a conventional grocery or convenience type store.

Conventional cooler display racks keep the first out product close to the cooler door and the cooler lights, thereby warming the product more than merchandise positioned on the rear of the shelf. The arc system cooler display rack provides individually adjustable shelves which can be moved forward or back relative to the cooler door without the need for repositioning of the entire display rack. Furthermore, the shelves can be individually adjusted vertically to accommodate varying heights of merchandise, and the shelves can be positioned variably between a 1° back slope inclination up to an 8° forward slope inclination relative to a horizontal plane for a gravity feed system as required.

The present invention achieves these objectives with a plurality of generally upright posts between which a number of shelves extend forward in a cantilevered manner. Supporting the shelves in a cantilevered fashion allows the posts to be positioned at the rear edge of each shelf thereby allowing full access through the cooler doors to the merchandise located on the shelves facing the cooler doors.

Each post is supported at a bottom end by an elongated shoe or base which is formed into an upwardly open channel. The bottom end of the post has a hook on a rear edge and a tab on a front edge which are both used to secure the posts between the channel side walls of the shoe base. To secure the post in the shoe, the hook is inserted into a slot in the rear of the shoe by tilting the post rearward until the hook is engaged and then pivoting the post to a generally vertical orientation which forces the tab on the front edge of the post into another slot also provided between the shoe channel side walls. The post is locked into the upright position once the front tab is secured below a detent protruding from one of the channel side walls at the forward slot.

The post secured to the shoe forms an L-shaped frame section from which the display rack is constructed. Each individual frame section is joined to an adjacent frame section by a spacing panel attached to the rear edge of each post just above the shoe. The frame sections are joined such that they are in generally parallel relationship to one another. An arc system cooler display rack of the present invention includes a number of joined frame sections depending upon the size of the walk-in cooler into which it is to be placed.

The shelves of the present invention are cantilevered between a pair of adjacent posts. Each post has two parallel columns of slots on each lateral side of the post. One column of slots is positioned near the front edge of the post and the other column is positioned near the rear edge of the post. Individual slots in the forward column are aligned with corresponding individual slots in the rear column such that, for example, a generally horizontal line will join the fifth slot from the uppermost end of the post on the rear column with the fifth slot from the uppermost end of the post on the forward column, and likewise for other pairs of slots.

Each shelf is supported between a pair of adjacent posts by a shelf support bracket which is used to attach a lateral edge of each shelf to an individual post. Each shelf support bracket has a support hook on both a front edge and a rear edge of one side the shelf support. The support hooks are designed to engage the slots arranged in the forward and rear columns on each post as previously described. Each shelf support bracket is of a general upwardly open channel configuration with the support hooks located on the upper edge of the forward and rear end of one of the channel side walls of the shelf support bracket. The support hook on the rear end of the shelf support bracket is inserted into a slot in the rear column of slots on the post, whereas the support hook on the front edge of the shelf support is inserted into one of the slots on the front column of slots on the post. The shelf support bracket is designed to position the shelf in a 1° back slope inclination when aligned slots in the rear and forward columns are used.

The gravity feed capability of the shelf can be implemented by utilizing a slot in the rear column of slots which is higher relative to the slot used by the shelf support bracket in the front column of slots on the post. In this way, once the shelf is secured to the shelf support bracket it will be sloped at an angle of up to 8° in a gravity feed position relative to a horizontal plane.

If the shelf is to be supported in a gravity feed position, approximately an 8° inclination can be provided by selecting the appropriate post slots in the forward and rear column as previously described. Additionally, variable gravity feed positions up to 8° can be achieved by adjusting a screw which is provided in each shelf support bracket. The screw is threadedly engaged through a hole in a bottom trough portion of each shelf support bracket and frictionally contacts the shelf supported thereon. Positive rotation of the screw will decrease the angular inclination of the shelf by pivoting the shelf upward. Likewise negative rotation of the screw will allow the shelf inclination to increase up to approximately 8°, thereby fully resting the shelf on the shelf support bracket.

Each shelf support bracket has a shelf hook and a stub which each project upwardly from a channel side wall spaced from a channel side wall which contains the support hooks. The shelf hook and stub are designed to engage pairs of holes which are aligned on the bottom of each shelf proximate each lateral edge. The various holes in each bottom lateral edge of edge shelf permit the shelf to be positioned relative to the post at three different depths. The shelf is secured to the shelf support bracket by first positioning a hole on each lateral edge of the shelf over a shelf hook on each shelf support between a pair of adjacent posts. Once each shelf hook is engaged in each lateral side of the shelf, the shelf can be pivoted downward until the stub is inserted into a corresponding hole in the shelf. On the underside of each lateral edge of the shelf there are provided there pair of corresponding holes which permit the shelf to be selectively positioned in three different locations backward or forward relative to the posts.

Merchandise located on the shelves of the arc system cooler display rack of the present invention is retained thereon by a number of bumper wires inserted into a upper surface of each shelf. Each bumper wire is a generally inverted U-shaped wire with a pair of downwardly extending legs. Each leg terminates at an end portion of the wire which is bent to form an obtuse angle with respect to the leg of the bumper wire from which it extends. The end portion is bent to an angle relative to the leg so that the bumper wire when in place on the shelf cannot be removed by simply pulling up on the bumper wire in a direction normal to the surface of the shelf.

The bumper wire is inserted into holes provided along the forward edge of each shelf's upper surface. The bumper wires are attached to the shelves by initially inserting the angled end portion of each leg into the shelf holes adapted to receive the bumper wire. This must be done with the legs of the bumper wires facing toward the shelf to form an acute angle with the surface of the shelf and the end portions generally normal to the shelf. Once the end portion of each leg is inserted into the holes, the bumper wire may be pivoted upward away from the shelf while continuing to apply a downward force on the bumper wire to further insert the end portion and leg into the hole. The end portion of each leg is inserted through a lower hole which is in a locking tab welded within the shelf. One end of the locking tab is welded to the bottom surface of the shelf and a free leaf end contains the hole through which is inserted the end portion of the bumper wire leg. The legs projected through the hole in the upper surface of the shelf. The bumper wire is in place once it is pivoted so that the legs form a generally right angle with respect to the surface of the shelf. The bumper wire retains merchandise displayed on the shelf and thereby prevent articles for rolling or falling off the front edge of the shelf when in a gravity feed orientation. The dual hole configuration in the shelf and locking tab and the leg and bent end portion prevent the bumper wire from being removed while merchandise is on gravity feed shelf in that for removal it must be pivoted toward the shelf where the merchandise is located.

A further feature of the cooler display rack of the present invention is an attachment bolt or other mechanism located on the lateral side of each self toward the front edge thereof. The attachment bolt secures the pair of adjacent shelves to one another thereby providing more support and rigidity to the overall display rack structure.

BRIEF DESCRIPTION OF THE DRAWINGS

The objectives and features of the invention will become more readily apparent from the following detailed description taken in conjunction with the accompanying drawings in which FIG. 1 is a perspective cross-section view of a walk-in cooler having a display rack according to the present invention contained therein;

FIG. 1A is an enlarged cross-sectional view of post secured in a shoe taken along line 1A—1A of FIG. 1;

DETAILED DESCRIPTION OF THE INVENTION

Figure 2:
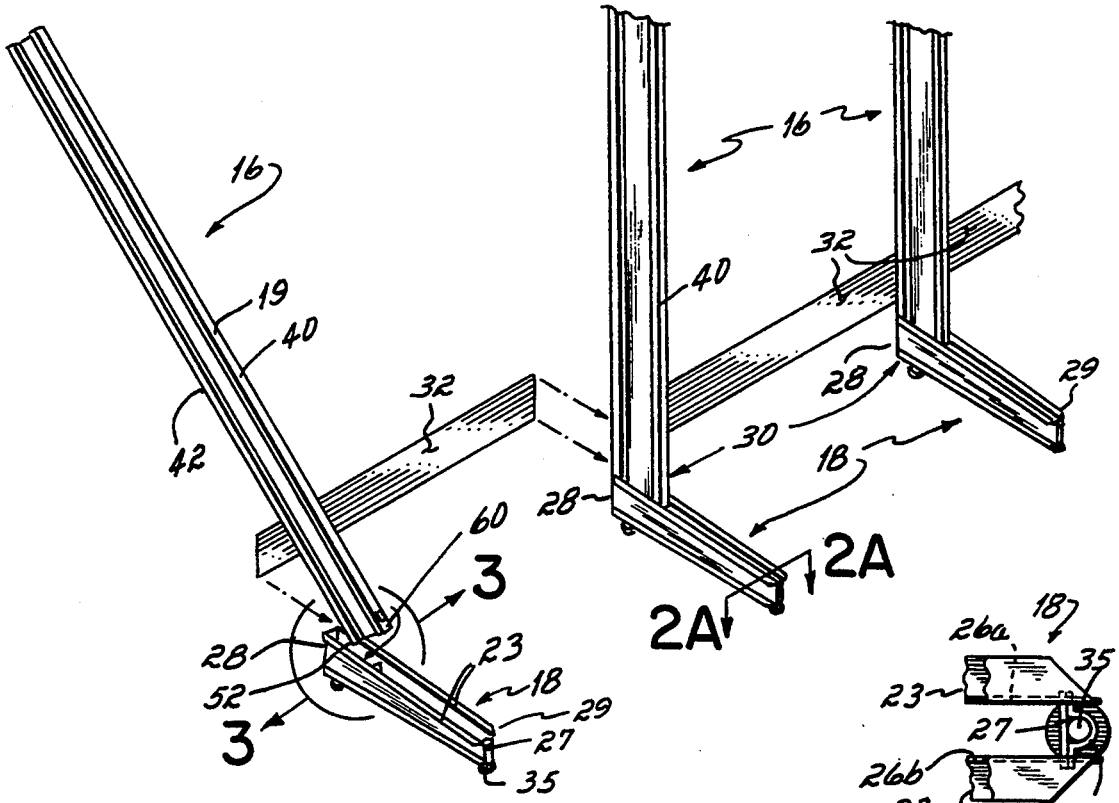
FIG. 2 is an elevated perspective view of a post of the display rack of FIG. 1 being inserted into a shoe to form an L-shaped frame section for attachment to other frame sections.

Referring to FIG. 1, the arc system cooler display rack 10 of the present invention is shown within a walk-in refrigerated cooler 12 for which access to merchandise contained on the display rack 10 is available through cooler doors 14. The cooler display rack 10 consists of generally vertical upright posts 16 which are supported by elongated shoes 18 which are located at a lowermost end 20 of the post on a floor 22 of the walk-in cooler. Each shoe 18 has an upwardly open channel 24 formed by a pair of shoe side walls *26a*, *26b*. The post 16 is secured between the shoe side walls 26 at the futhermost back end 28 of each shoe 18.

The post 16 and shoe 18 combination form a generally L-shaped frame section 30 of which a plurality of L-shaped frame sections are joined in a generally parallel configuration by a spacing panel 32 (FIG. 2).

A plurality of shelves 34 are attached in a cantilever manner between each pair of adjacent upright posts 16 in the present invention. The shelves 34 are attached to the posts 16 such that they extend forward to the cooler doors 14 thereby allowing access by customers through the cooler doors to the merchandise contained thereto. In the arc system cooler display rack 10 of the present invention full access is available to merchandise contained on the shelves 34 in that there are no front posts to obstruct to the merchandise. Furthermore, the selves 34 can be restocked at the appropriate times by accessing a rear edge 36 or the shelves between the upright posts 16.

A cross-sectional view of a post 16 within the shoe 18 is shown in FIG. 1A. Each post 16 is configured as having a pair of open channels 15,15 each formed by a pair of generally parallel sidewalls 17*a*, 17*b* which are joined by an end channel 19. The channels 15, 15 open toward one another and are joined by a center panel 21 which is an extension of each of the opposing sidewalls 17*b*, 17*b*. The center panel 21 is offset from the sidewalls 17*b*, 17*b* such that it is flush with an insert 53 which is positioned in a bottom end 20 of the post 16. The insert 53 is secured in place by a bolt 31 which is threadably engaged by a collar 33 attached to the insert 53.

The posts 16 of the present invention include on each lateral side wall 17*a*, 17*b* thereof a pair of parallel slot columns 44, 46 of which one column of slots 44 is located near forward edge 40 of the post and the other column of slots 46 is positioned near a rear edge 42 of each post. The forward column of slots 44 and rear column of slots 46 are each used to support the shelves 34 which may be repositioned vertically along the height of the post 16, within a horizontal plane forward or backward relative to the post 16, and angularly on an incline relative to a horizontal plane. The angular inclination of the shelves 34 provides for a gravity feed system which allows merchandise to be accessed by the customer at a front edge 48 of each shelf and restocked by a store employee from the rear edge 36 of each shelf. A bumper wire 50 as shown in FIG. 1 is provided at the front edge 48 of each shelf to retain the merchandise contained thereon. The selective positioning of the shelves 34 will be described later in this detailed disclosure of the invention.

Figure 2A:
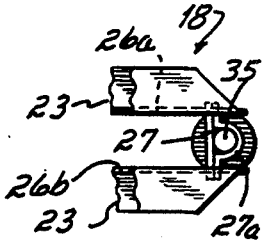
FIG. 2A is an enlarged cross-sectional view of the forwardmost portion of the shoe taken along line 2A—2A of FIG. 2.
Figure 4:
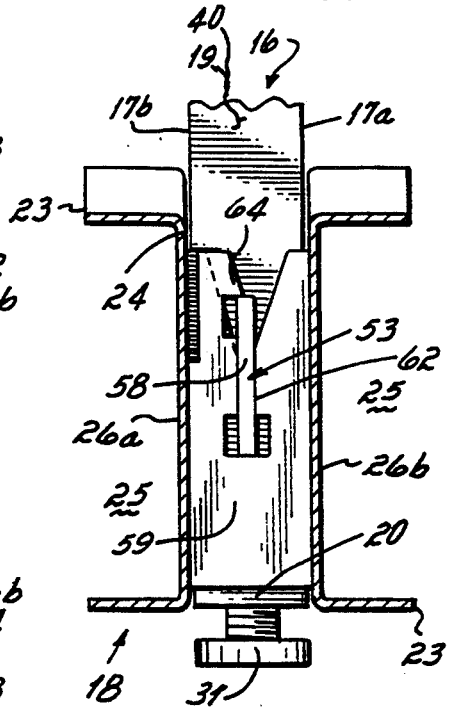
FIG. 4 is a cross sectional front view taken along line 4—4 of FIG. 3A showing the front tab on the bottom end of the post secured in place within the slot provided in the shoe.

FIG. 2 shows the post 16 being inserted into the shoe 18 of the present invention to form the frame section 30 which can be joined by the spacing panel 32 to other frame sections 30. A cross-sectional view of the shoe 18 as in FIG. 4 shows that it is constructed of a pair of U-shaped channels 23, 23 positioned with an opening of each channel 25, 25 directed away from one another. The side walls 26*a*, 26*b* of each shoe form the bottoms of the U-shaped channels 23, 23 and are positioned generally vertical, adjacent, and parallel to each other. As seen in FIG. 2A, the channels 23, 23 are joined by a shoe support 27 at a forward end 29 of each shoe 18. The shoe support 27 includes a collar 27*a* through which a bolt 35 is threadably engaged. The bolts 31, 35 support the shoe at each end and provide for levelling adjustments of the frame section 30 in that the bolts 31, 35 rest on the floor 22 of the cooler 12.

Figure 3:
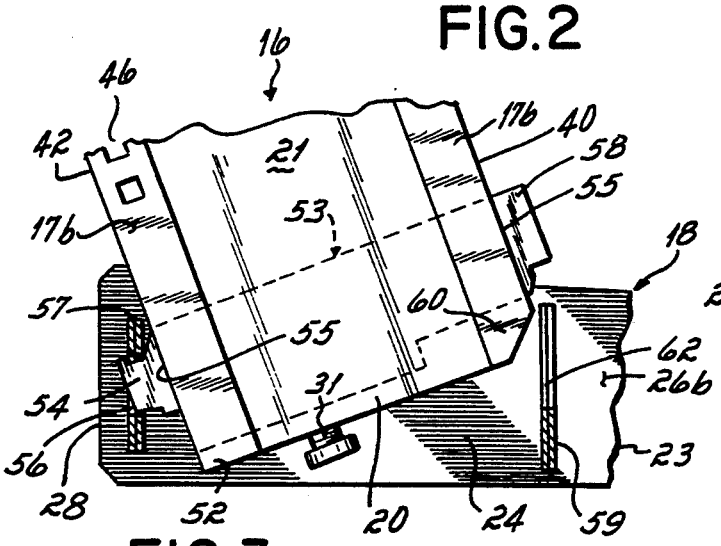
FIG. 3 is an enlarged cross sectional side view of the area of region 3—3 in FIG. 2 as the post is being inserted into the shoe.

To secure the post 16 into the shoe 18 it must be titled backward with a rearmost bottom edge 52 of the post being inserted into the upwardly open channel 24 provided in the shoe 18. A hook 54 is provided at the rear edge of the bottom end 52 of each post and a tab 58 extends from a forwardmost bottom edge 60 of each post. The hook 54 and tan 68 are on opposite ends of the insert 53 which is located within the bottom end 20 of each post as previously described. The hook 54 and tab 58 project out of the post 16 through slots 55, 55 in the end portion 19 of each post open channel 15. The hook 54 must be inserted into a rear shoe slot 56 as shown in FIG. 3. The rear shoe slot 56 is in a rear shoe support 57 which joins the shoe channels 23, 23 at the back 28 of the shoe 18.

Figure 3A:
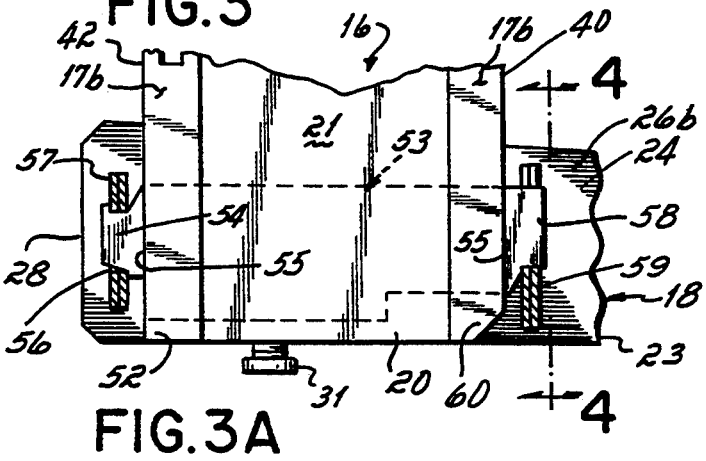
FIG. 3A is a view similar to FIG. 3 after the post has been securely pivoted in place within the shoe.

Once the hook 54 engages the rear shoe slot 56, the post 16 can be pivoted forward until it reaches a generally vertical orientation at which time the tab 58, provided on the forwardmost bottom edge 60 of the post, will slide within a shoe front slot 62 located in a middle shoe support 59, as shown in FIGS. 3A and 4. Once the tab 58 is seated in the forward show slot 62, a detent 64 on the middle shoe support 59 which projects into the forward show slot 62 engages the tab 58, thereby securing the post 16 within the shoe 18. Once the post 16 is secured to the shoe 18 in a generally vertical orientation, the L-shaped frame member 30 is formed which can then be joined to other L-shaped frame members 30 by the spacing panel 32 which is screwed or fastened by another appropriate mechanism to the rear edge 42 of the post just above the shoe 18 as shown in FIG. 2.

Figure 5:
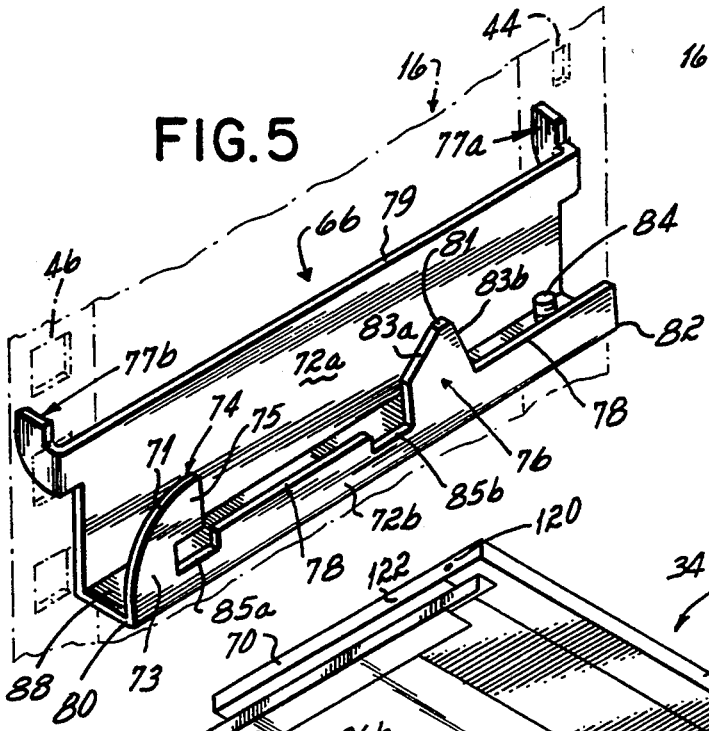
FIG. 5 is a perspective view of a shelf support bracket of the present invention attached to a post shown in phantom.
Figure 7:
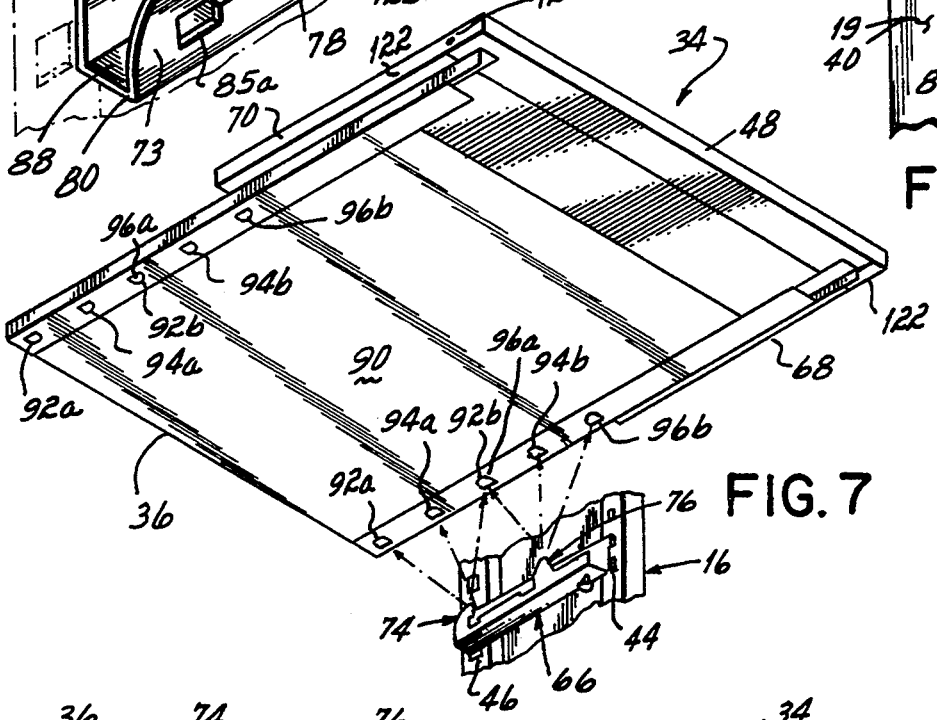
FIG. 7 is a perspective view from the underside of a shelf which has holes arranged on each lateral edge thereof into which the shelf support bracket hook and stub can be inserted for positioning the shelf forward or backward relative to the post.

Once the appropriate number of frame sections 30 have been joined to fit within the specific dimensions of the walk-in cooler 12, the shelves 34 can be attached between an adjacent pair of posts 16. The shelves 34 are attached to a post 16 by a shelf support bracket 66 on each lateral edge of the shelf. A shelf support bracket which would be suitable for attaching a right side 68 of the shelf to a post 16 is shown in FIG. 7; a similarly designed shelf support bracket 66 would be configured for attachment on a left side 70 of each shelf. As best seen in FIG. 5, each shelf support bracket 66 is generally configured as a U-shaped channel with a pair of channel side walls 72*a*, 72*b* one of which side walls 72*a* has a taller flat edge top surface spaced from the other side wall 72*b* which is of lower height having a shelf hook 74 and a stub 76 extending upward from a top edge 78 thereof. For purposes to be described below, the top edge 78 of side wall 72*b* is sloped at approximately a 1° angle with respect to the top edge 79 of wall 72*a*. That is, the front edge 82 is higher than the rear edge 80 to provide an approximate 1° rearward inclination. The shelf hook 74 is positioned proximate a rear edge 80 of the shelf support bracket sidewall 72*b* and the stub 76 is positioned proximate a front edge 82 of the shelf support bracket sidewall 72*b*. The opposing side wall 72*a* has support hooks 77*a*, 77*b* located at each end of the shelf support bracket 66 on an upper edge 79 thereof.

The shelf hook 74 is of an L-shape having a generally vertical leg 73 which projects up from the side wall 72*b*. A generally horizontal leg 75 extends from the vertical leg 73 and in combination therewith forms the shelf hook 74. The outer surface of the connection between the legs 73 and 75 is formed into an arcuate bend 71 in order to better facilitate the insertion of the shelf hook 74 into the shelf 34 of the present invention. The stub 76 is shaped as a non-symmetric truncated triangle with a flat upper surface 81 and pair of sloped sides 83*a*, 83*b* which connect the flat upper surface 81 to the side wall 72*b*. Adjacent to each of the stub 76 and the shelf hook 74 are cut-outs 85*a*, 85*b* in the top edge 78 of side wall 72*b* in order to assist in attachment of the shelf support bracket 66 to the shelf 34.

Figure 6:
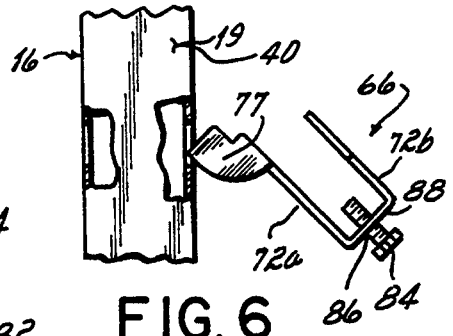
FIG. 6 is a front end view of the hook of the shelf support bracket being inserted into the slot provided on the post of the present invention.
Figure 6A:
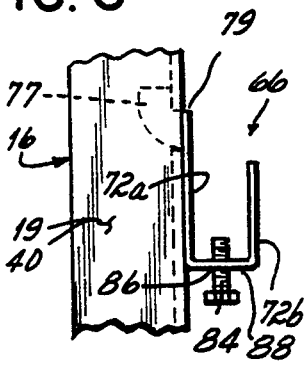
FIG. 6A is a view similar to FIG. 6 after the shelf support has been secured to the post.

FIGS. 6 and 6A show the shelf support 66 being secured to the post slots which 44, 46 are arranged in dual columns on each post 16. The support hooks 77*a*, 77*b* are inserted into the post slot initially with the shelf support 66 oriented at an angle relative to the post 16 as shown in FIG. 6. Once each support hook 77*a*, 77*b* is seated in a post slot in the forward post slot column 44 and the rear post slot column 46, respectively, the shelf support 66 is the pivoted to be parallel with the side 17 of the post as shown in FIG. 6A.

Figure 8:
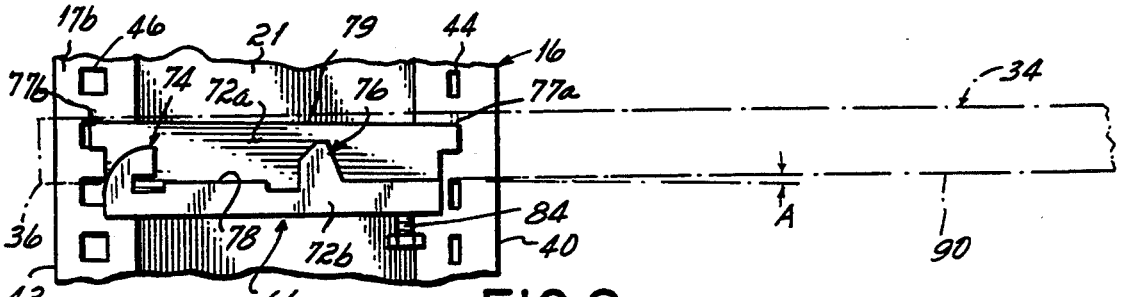
FIG. 8 is a side view showing the post and shelf support bracket attached to a post and with a shelf shown in phantom in an approximately 1° back slope position relative to a horizontal plane.

When the shelf support 66 is positioned in horizontally aligned slots from each column 44, 46, the shelf 34 supported thereon would be inclined rearwardly as shown by angle A at approximately a 1° back slope relative to a horizontal plane because of the slope of sidewall 72*b* as shown in FIG. 8. The angled back slope configuration helps prevent merchandise from sliding towards the front edge 48 of the shelf, if so desired. However, an angle B of as much as an 8° forward slope gravity feed shelf orientation can be achieved by inserting the rear support hook 77*b* into a post slot in the rear slot column 46 one position above the post slot into which support hook 77*a* is inserted in the front post column 44, as shown by comparing FIGS. 8 and 8A. The gravity feed orientation for the shelf 34 in an arc system cooler display rack 10 is desirable for restocking purposes in that once the forwardmost item on the shelf 34 is removed by the customer, as a result of the gravity feed inclination of the shelf subsequent items would advance forward and be retained by the bumper wires 50 which are described later in this disclosure.

Figure 8A:
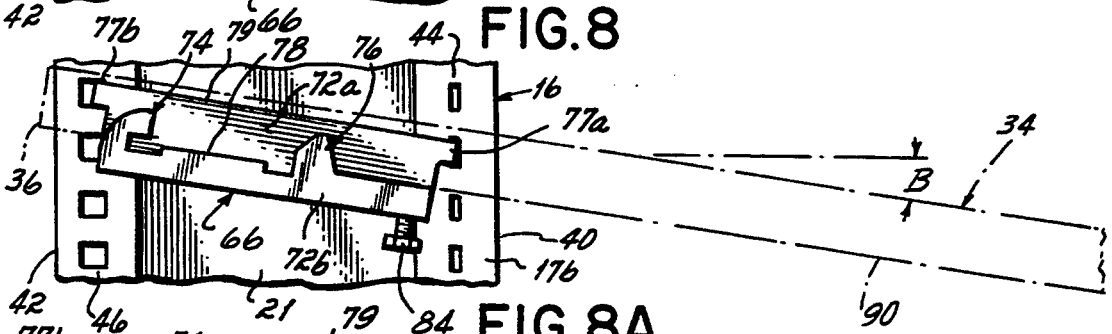
FIG. 8A is a view similar to FIG. 8 showing the shelf in phantom in an approximately 8° forward slope gravity feed position.
Figure 8B:
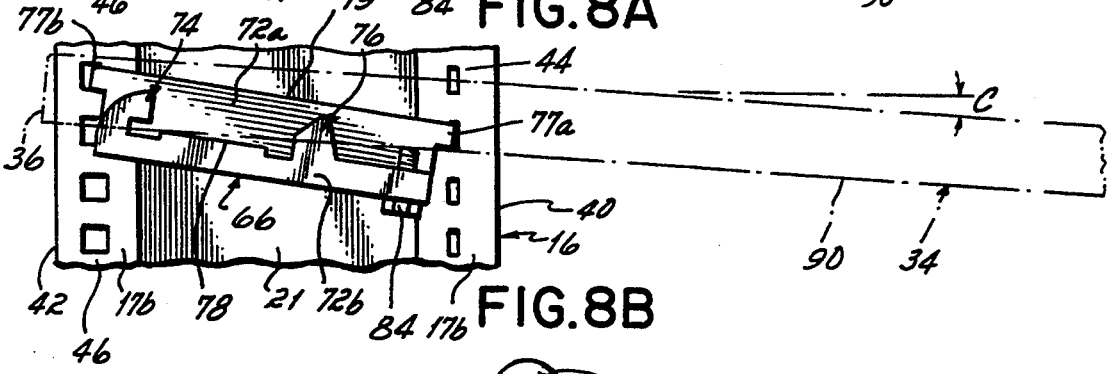
FIG. 8B is a view similar to FIG. 8A showing the shelf in phantom in an approximately 4° forward slope gravity feed position.

FIG. 8B shows the shelf 34 with the support hooks 77*a*, 77*b* located in the same post slot configuration as shown in FIG. 8A, but the shelf 34 of FIG. 8B is positioned at an angle C of approximately a 4° forward slope gravity feed orientation as a result of a screw 84 provided through a threaded hole 86 in a bottom portion 88 of the shelf support. Positive rotation advances the screw 84 through the hole 86 which threadably engages the screw 84. As the screw 84 is rotated and advanced, it contacts a bottom surface 90 of the shelf thereby pivoting the shelf 34 about the shelf hook 74 and adjusting the inclination of the shelf 34 to any orientation between approximately an 8° forward slope as shown by angle B in FIG. 8A to approximately a 4° forward slope as shown by angle C in FIG. 8B depending on the amount of screw rotation. In order to have an appropriately adjusted shelf 34 in the gravity feed orientation of the cooler display rack 10 of the present invention, the shelf support bracket 66 on both the right 68 and left sides 70 of each shelf 34 should be positioned identically in that corresponding post slots should be employed for each post 16 used in supporting each shelf 34 and each screw 84 positioned in each shelf support bracket 66 should be similarly positioned relative to one another.

Figure 7A:
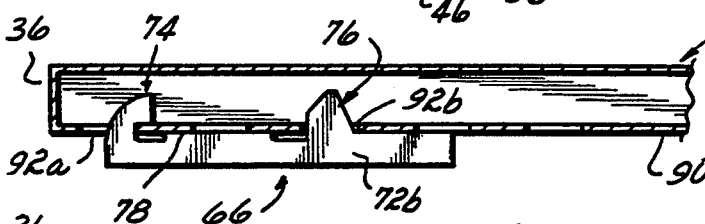
FIG. 7A is a cross-sectional view thru the shelf showing the hook and stub of a shelf support bracket inserted into a pair of holes on the underside of the shelf thereby positioning the shelf in the forwardmost position relative to the post.
Figure 7B:
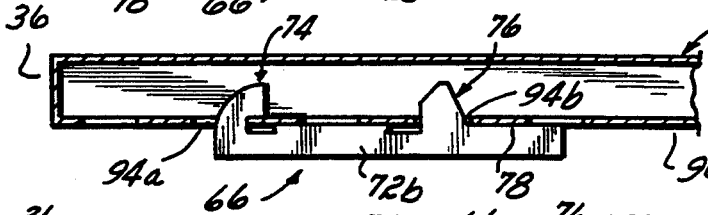
FIG. 7B is a view similar to FIG. 7A showing the shelf hook and stub of a shelf support bracket inserted into another pair of holes thereby positioning the shelf in a middle position relative to the post.
Figure 7C:
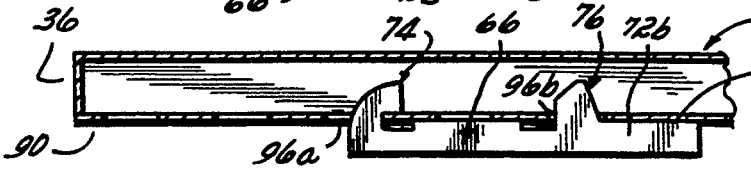
FIG. 7C is a view similar to FIG. 7A showing the shelf hook and stub of the shelf support bracket inserted into yet another pair of holes thereby positioning the shelf in a most rearward position relative to the post.

As shown in FIG. 7, the shelf support bracket 66 engages a series of hole pairs 92*a–b*, 94*a–b*, 96*a–b*, in the bottom side 90 of each shelf along each lateral edge 68, 70. The stub 76 and shelf hook 74 are each inserted into the holes on the bottom side 90 of the shelf. The holes are arranged in three pairs 92, 94 and 96 as shown in FIG. 7. The center hole 92*b*, 96*a* is used as the forward hole 92*b* in pair 92, and the rear hole 96*a* in pair 96. The rearmost hole of each pair 92*a*, 94*a* and 96*a* would be a hook hole adapted to receive the shelf hook 74, and the forwardmost 92*b*, 94*b* and 96*b* of each pair would be a stub hole adapted to receive the stub 76 on the shelf support bracket 66. The provision of multiple pairs of holes for positioning the shelf 34 at various locations forward and aft relative to the post 16 is shown in FIGS. 7A, 7B, and 7C. FIG. 7A shows the position of the shelf 34 relative to the shelf support bracket 66 when the pair of holes 92*a*, 92*b* on the bottom side of each lateral edge of the shelf are utilized. This configuration will provide the shelf 34 with its most forward position relative to the post 16. FIG. 7B shows the positioning of the shelf 34 when the pair of holes identified as 94*a*, 94*b* are utilized. Similarly, FIG. 7C shows the positioning of the shelf 34 at the most rearward location available in the cooler display rack 10 of the present invention by utilizing the pair of holes identified as 96*a*, 96*b*.

The capability of selectively positioning the shelves 34 forward or aft relative to the post 16 is shown in FIG. 1 by comparing the relative positions of the shelves shown in the cooler display rack of the present invention. A bottom shelf 98 is in the most forward position in which holes 92*a*, 92*b* are used; a second lowest shelf 100 is in the middle position utilizing the holes 94*a*, 94*b*. Center shelves 102, 102 are in the most rearward position in which holes 96*a*, 96*b* are used. The capability of positioning the shelves forward and aft relative to the posts, vertically along the height of the post, and at variable gravity feed inclinations offers the convenience or grocery store manager flexibility in merchandising products to be displayed on the cooler display rack of the present invention.

Figure 9:
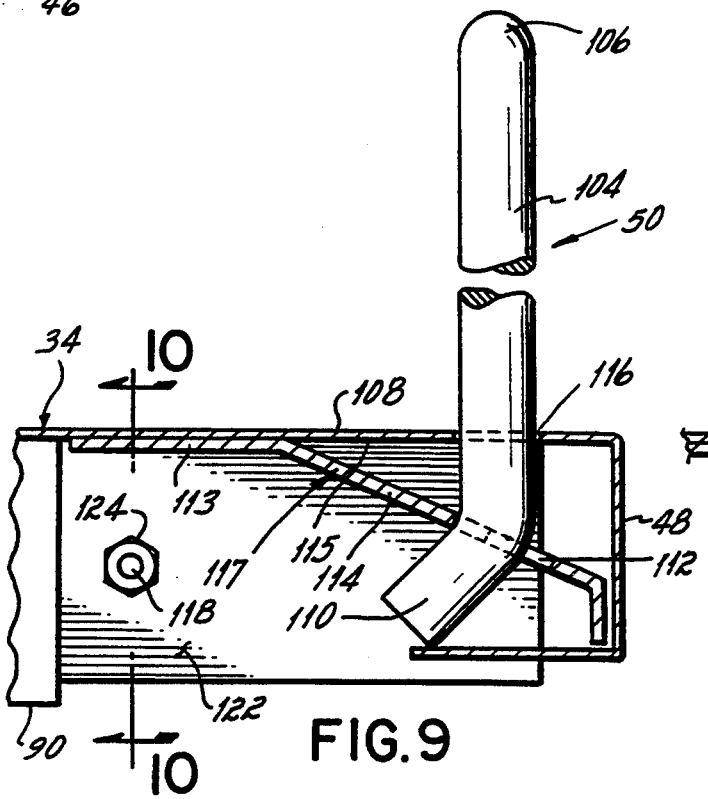
FIG. 9 is a cross sectional view taken along line 9—9 of FIG. 1 showing the forwardmost portion of the shelf with a bumper wire instead therein.

FIG. 9 shows the bumper wire 50 positioned within a shelf 34 of the cooler display 10 rack of the present invention. The bumper wire 50 is a generally inverted U-shaped wire as shown in FIG. 1, with a pair of downwardly extending legs 104 joined by a cross bar 106. In FIG. 9, the legs 104 are positioned orthogonal to an upper surface 108 of the shelf. An end portion 110 of each leg is bent to form an obtuse angle with respect to the leg 104. The end portion 110 is seated through a lower hole 112 in a locking tab 114 welded to a bottom side 115 of the shelf surface 108 as shown in FIG. 9. The locking tab 114 has a welded portion 113 which is welded or otherwise affixed to the bottom side 115 of the upper surface 108 of the shelf 34. Forming an obtuse angle with the welded portion 113 is a leaf 117 in which the lower hole 112 is located. The leaf 117 is spaced from and angled with respect to the bottom side 115. The lower hole 112 is positioned at the point where the leg 104 is angled to form the end portion. The leg 104 projects through a hole 116 in the upper surface 108 of the shelf.

The bumper wire 50 inserted into the shelf upper surface 108 and the locking tab 114 insures that a customer cannot remove the bumper wire 50 by merely pulling on the bumper wire 50 in a direction normal to the upper surface 108 of the shelf. The leaf 117 retains the angle end portion 110 to inhibit the bumper wire 50 from being removed orthogonally relative to the upper surface 108 of the shelf. In order to remove the bumper wire 50 from the shelf 34, it must be pulled upward and simultaneously pivoted toward the rear end 36 of the shelves so that the end portion 110 of the bumper wire leg can be removed from the lower hole 112 in the leaf 117 within the shelf. Therefore, if merchandise is accumulated on the shelf 34 and being retained by the bumper wire 50, the bumper wire 50 could not be removed in that it could not be pivoted towards the rear edge 36 of the shelf due to the merchandise contained thereon.

In order to insert the bumper wire 50 into the shelf 34, the end portion 110 of the leg would be initially inserted normal to the upper surface 108 of the shelf through the upper hole 116, and then as the bumper wire 50 is pushed down it is simultaneously pivoted toward the front edge 48 of the shelf so the end portion 110 can project through the lower hole 112 in the lower panel 114 of the shelf to achieve the configuration shown in FIG. 9.

Figure 10:
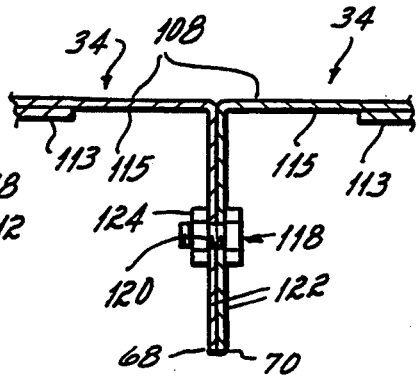
FIG. 10 is cross sectional front view taken along line 10—10 of FIG. 9 showing the attachment bolt joining adjacent shelves of the present invention.

A final feature of the arc system cooler display rack of the present invention is a shelf connecting bolt 118 as shown in FIG. 10. The bolt 118 or other suitable attachment mechanism, would be used to join adjacent shelves 34 on a cooler display 10 rack in order to provide more stability and rigidity to the rack structure as a whole. The shelf attachment bolt 118 would be inserted through a hole 120 in a downwardly extending flange 122 on each lateral edge 68, 70 on an adjacent pair of shelves 34 and would be secured in place by a nut 124 as shown in FIG. 10. The provision of a shelf attachment bolt 118 would be an optional feature to the construction of the present invention in that it does provide more stability to the shelf structure, but also requires that adjacent shelves 34 be identically positioned on the respective shelf support brackets 66 which may not be the case for certain applications of the present invention.

From the above disclosure of the general principles of the present invention and the preceding description of the preferred embodiment those skilled in the art will readily comprehend the various modifications to which the present invention is susceptible. Therefore, I desire to be limited only by the scope of the following claims.

I claim:

1. A display rack for providing access to merchandise supported thereon comprising:

a plurality of generally upright posts having a top end, a bottom end, a front edge, a rear edge, and a pair of lateral spaced sides;

base means attached to the bottom end of each said post for bracing said post in a generally vertical orientation, said post and said base means forming a generally L-shaped frame section;

connecting means for joining in spaced and generally parallel relation each said frame section to an adjacent said frame section; and a plurality of shelves extending between an adjacent pair of said posts, each said shelf being secured by attachment means for mounting said shelf in a generally cantilever manner between said adjacent pair of posts, said attachment means facilitating the selective vertical positioning of said shelf between said post top end and bottom end, horizontal positioning of said shelf relative to said post front edge and rear edge, and angular inclination of said shelf relative to a horizontal plane, said attachment means permitting the selective vertical, horizontal and angular inclination positioning of said shelf irrespective of the vertical, horizontal and angular inclination position of said shelf.

2. The display rack of claim 1 further comprising:

stop means on said shelf for retaining merchandise supported thereon.

3. The display rack of claim 2 wherein said stop means comprises a plurality of generally inverted U-shaped bumper wires each of which have a pair of downwardly extending legs which each terminate at an end portion, said end portion forming an obtuse angle with said leg, each said leg and said end portion being generally orthogonal to a crossbar joining said pair of legs, said shelf having holes adapted to receive said end portions such that when said end portions are inserted into said holes and said bumper wire is pivoted with respect to said shelf, said end portions are embedded in said shelf holes thereby securing said bumper wire in said shelf by preventing removal of said bumper wire from pulling on said bumper wire in a direction orthogonal to said shelf.

4. The display rack of claim 1 wherein said base means comprises an elongated shoe having an upwardly open channel in a top edge thereof formed by a pair of channel walls, said open channel being adapted to receive the bottom end of said post when inserted therein, said shoe having locking means for engaging and securing said post in an upright orientation.

5. The display rack of claim 4 wherein said locking means comprises a hook on the rear edge of the bottom end of said post which is received in a slot in a rear end of said shoe, and a tab on the front edge of the bottom end of said post which slides into a slot in a front end of said shoe, said tab being engaged by a detent projecting from one of the channel walls.

6. The display rack of claim 1 wherein said attachment means comprises a plurality of post slots on each lateral side of said post, said post slots being arranged in a column proximate the front edge of said post and in a parallel column proximate the rear edge of said post, said post slots being adapted to receive a shelf support bracket having a pair of support hooks, a first support hook engaging a slot in said front edge column on said post and a second support hook engaging a slot in said rear edge column on said post, each said shelf support bracket having shelf support means for supporting said shelf, said attachment means facilitating the selective vertical positioning of said shelf between said post top end and bottom end depending upon the position of said front edge slot and said rear edge slot engaged by said pair of support hooks, said attachment means also facilitating the selective angular inclination of said shelf with respect to a horizontal plane depending upon the position of said front edge slot relative to said rear edge slot engaged by said pair of support hooks.

7. The display rack of claim 6 wherein said shelf support means comprises a plurality of hook holes and stub holes aligned proximate each lateral edge of each said shelf, each said hook hole having a corresponding said stub hole on the same lateral edge of said shelf, each said shelf support bracket having a shelf lock hook for insertion into one of said hook holes and a support stub for engaging said corresponding stub hole, said shelf support means facilitating the selective positioning of said shelf within a horizontal plane between said adjacent pair of said posts depending upon which said hook hole and corresponding said stub hole engage said shelf lock hook and said support stub.

8. The display rack of claim 6 further comprising:

a screw threadably engaged through a hole in said shelf support bracket and frictionally engaged with said shelf such that positive rotation of said screw in a first direction increases the angular inclination of said shelf relative to a horizontal plane and reverse rotation of said screw in a second direction decreases the angular inclination of said shelf.

9. The display rack of claim 1 further comprising:

shelf front connecting means for securing a front edge of said shelf to a front edge of an adjacent said shelf, said front edge of said shelf being spaced from a rear edge of said shelf proximate said posts.

10. In combination, a walk-in cooler and a cooler display rack for providing displayed access to merchandise supported upon the rack and located within the walk-in cooler, said cooler display rack comprising:

a plurality of generally upright posts having a top end, a bottom end, a front edge, a rear edge, and a pair of lateral spaced sides;

base means attached to the bottom end of each said post for bracing said post in a generally vertical orientation, said post and said base means forming a generally L-shaped frame section;

connecting means for joining in spaced and generally parallel relation each said frame section; and a plurality of shelves extending between an adjacent pair of said posts, each said shelf being secured by attachment means for mounting said shelf in a generally cantilever manner between said adjacent pair of posts, said attachment means facilitating the selective vertical positioning of said shelf between said post top end and bottom end, horizontal positioning of said shelf relative to said post front edge and rear edge, and angular inclination of said shelf relative to a horizontal plane, said attachment means permitting the selective vertical, horizontal and angular inclination positioning of said shelf irrespective of the vertical, horizontal and angular inclination position of said shelf.

11. The combination of claim 10 further comprising: shelf front connecting means for securing a front edge of said shelf to a front edge of an adjacent said shelf, said front edge of said shelf being spaced from a rear edge of said shelf proximate said posts.

12. The combination of claim 10 further comprising: stop means on said shelf for retaining merchandise supported thereon.

13. The combination of claim 12 wherein said stop means comprises a plurality of generally inverted U-shaped bumper wires each of which have a pair of downwardly extending legs which each terminate at an end portion, said end portion forming an obtuse angle with said leg, each said leg and said end portion being generally orthogonal to a crossbar joining said pair of legs, said shelf having holes adapted to receive said end portions such that when said end portions are inserted into said holes and said bumper wire is pivoted with respect to said shelf, said end portions are embedded in said shelf holes thereby securing said bumper wire in said shelf by preventing removal of said bumper wire from pulling on said bumper wire in a direction orthogonal to said shelf.

14. The combination of claim 10 wherein said base means comprises an elongated shoe having an upwardly open channel in a top edge thereon formed by a pair of channel walls, said open channel being adapted to receive the bottom end of said post when inserted therein, said shoe having locking means for engaging and securing said post in an upright orientation.

15. The combination of claim 14 wherein said locking means comprises a hook on the rear edge of the bottom end of said post which is received in a slot in a rear end of said shoe, and a tab on the front edge of the bottom end of said post which slides into a slot in a front end of said shoe, said tab being engaged by a detent projecting from one of the channel walls.

16. The combination of claim 10 wherein said attachment means comprises a plurality of post slots on each lateral side of said post, said post slots being arranged in a column proximate the front edge of said post and in a parallel column proximate the rear edge of said post, said post slots being adapted to receive a shelf support bracket having a pair of support hooks, a first support hook engaging a slot in said front edge column on said post and a second support hook engaging a slot in said rear edge column on said post, each said shelf support bracket having shelf support means for supporting said shelf, said attachment means facilitating the selective vertical positioning of said shelf between said post top end and bottom end depending upon the position of said front edge slot and said rear edge slot engaged by said pair of support hooks, said attachment means also facilitating the selective angular inclination of said shelf with respect to a horizontal plane depending upon the position of said front edge slot relative to said rear edge slot engaged by said pair of support hooks.

17. The combination of claim 16 wherein said shelf support means comprises a plurality of hook holes and stub holes aligned proximate each lateral edge of each said shelf, each said hook hole having a corresponding said stub hole on the same lateral edge of said shelf, each said shelf support bracket having a shelf lock hook for insertion into one of said hook holes and a support stub for engaging said corresponding stub hole, said shelf support means facilitating the selective positioning of said shelf within a horizontal plane between said adjacent pair of said posts depending upon which said hook hole and corresponding said stub hole engage said shelf lock hook and said support stub.

18. The combination of claim 16 further comprising: a screw threadably engaged through a hole in said shelf support bracket and frictionally engaged with said shelf such that positive rotation of said screw in a first direction increases the angular inclination of said shelf relative to a horizontal plane and reverse rotation of said screw in a second direction decreases the angular inclination of said shelf.

* * * * *

UNITED STATES PATENT AND TRADEMARK OFFICE

CERTIFICATE OF CORRECTION

PATENT NO. : 5,333,746

DATED : August 2, 1994

INVENTOR(S) : Rafael T. Bustos

It is certified that error appears in the above-indentified patent and that said Letters Patent is hereby corrected as shown below:

Column 4, line 39, "of edge shelf" should read —of each shelf—.

Column 4, line 48, "provided there" should read —provided three—.

Column 5, line 43, "of post" should read —of a post—.

Column 5, line 64, "of the shelf" should read —of a shelf—.

Column 6, line 31, "wire instead" should read —wire inserted—.

Column 6, line 32, "is cross" should read —is a cross—.

Column 6, line 63, "to obstruct to" should read —to obstruct access to—.

Column 6, line 63, "selves" should read —shelves—.

Column 6, line 65, "or" should read —of—.

Column 7, line 14, "near forward" should read —near a forward—.

Column 7, line 48, "titled" should read —tilted—.

Column 8, line 1, "show" should read —shoe—.

Column 8, line 3, "show" should read —shoe—.

Column 13, line 40, "thereon" should read —thereof—.

Signed and Sealed this

Sixth Day of December, 1994

Bruce Lehman

*Attest:*

BRUCE LEHMAN

*Attesting Officer*

*Commissioner of Patents and Trademarks*